United States Patent [19]

Puccio

[11] 4,067,660

[45] * Jan. 10, 1978

[54] ELASTOMERIC EXPANSION SEAL

[75] Inventor: Guy S. Puccio, Snyder, N.Y.

[73] Assignee: Acme Highway Products Corporation, Buffalo, N.Y.

[ * ] Notice: The portion of the term of this patent subsequent to Nov. 30, 1993, has been disclaimed.

[21] Appl. No.: 702,044

[22] Filed: July 2, 1976

Related U.S. Application Data

[63] Continuation-in-part of Ser. No. 629,517, Nov. 6, 1975, Pat. No. 3,994,609.

[51] Int. Cl.[2] ..... E01C 11/04

[52] U.S. Cl. ..... 404/69; 404/65; 52/396

[58] Field of Search ..... 404/69, 68, 47, 48, 404/49, 64, 65; 52/396, 403

[56] References Cited

U.S. PATENT DOCUMENTS

| | | | |
|---|---|---|---|
| 3,527,009 | 9/1970 | Nyquist | 404/69 |
| 3,626,822 | 12/1971 | Koster | 404/69 |
| 3,722,379 | 3/1973 | Koster | 404/68 |
| 3,850,539 | 11/1974 | Bowman | 404/69 |
| 3,887,292 | 6/1975 | Koster | 404/69 |
| 3,888,599 | 6/1975 | Reifsnyder | 404/69 |
| 3,994,609 | 11/1976 | Puccio | 404/69 |

*Primary Examiner*—Nile C. Byers

*Attorney, Agent, or Firm*—Christel & Bean

[57] ABSTRACT

An expansion joint strip seal for use in roadways, bridges, buildings, and the like adapted for use with a pair of elongated, parallel, spaced apart edge members defining a gap therebetween and each of the edge members having a generally C-shaped cavity opening toward said gap. The seal includes mounting beads on each of its longitudinal edges for mounting within the aforesaid edge member cavities and a downwardly folding resilient web member spanning the aforesaid gap and being attached to the mounting beads. Each mounting bead is of tubular construction and includes an outer wall surface configuration adapted for engagement in said cavity. A substantial part of the mid-portion of the mounting bead outer wall in an unstressed, disassembled condition includes a radius of curvature which is less than the radius of curvature of the cavity so that upon assembly of the mounting bead within the cavity the curved outer wall mid-portion is forced to assume the curvature of the cavity resulting in a highly effective mounting of the bead. To facilitate such deformation and assembly of the mounting bead, each of the edges of the outer wall adjacent to the curved mid-portion are provided with reliefs. In addition, the wall portion of each mounting bead adjacent to the aforesaid gap is of a S-shaped configuration, the latter acting as a spring to resiliently retain the bead in a firmly mounted disposition during the various degrees of expansion and contraction of the gap defined between the edge members.

16 Claims, 7 Drawing Figures

ELASTOMERIC EXPANSION SEAL

This application is a continuation-in-part of my U.S. Pat. No. 3,994,609, issued Nov. 30, 1976, entitled "Elastomeric Expansion Seal."

BACKGROUND OF THE INVENTION

This invention relates generally to expansion joint seals of the type used for sealing an expansion joint space or gap against the intrusion of dirt, water and other debris as for example might be encountered by expansion joints employed in roadway construction. More specifically, the present invention relates to an elastomeric expansion seal that may be employed in a joint assembly having elongated, metal edge members installed on either side of the gap as defined by a pair of structural members such as concrete slabs wherein the seal is connected between said edge members.

One problem encountered with many available expansion joint seals is that the retaining or mounting bead portions become dislodged from one of the edge members over part or all of the longitudinal lengths of the joint with the result that the seal no longer remains watertight and thus, ceases to perform one of the principal functions for which it was provided.

There have been various proposals for design of the seal mounting beads and other approaches to the design of expansion joint seals in general which have had the objective of minimizing the possibility of failure of the joint by dislodging of the seal from the frame or edge members of the assembly. In regard to expansion seals having mounting beads along the longitudinal edges thereof for mounting in a corresponding cavity of the edge members, a number of specific problems have been encountered. It has been found very difficult in the prior art to form metal edge members having a cavity therein of predetermined cross section which includes any degree of high tolerance along the entire extruded length of such an edge member. For example in extruding a metal edge member with a cavity therein on the order of 16 feet in longitudinal length, as might be utilized in a road joint, it has been found that the extrusion process fails to maintain uniformity in the cross sectional dimensions of the cavity along the entire longitudinal length thereof. On the other hand, it has been found possible in the prior art to maintain a relatively high degree of tolerance with respect to the outer surface cross sectional dimensions of an extruded mounting or retaining bead of an expansion seal. Necessarily, the resultant differences in uniformity between the aforesaid seal beads and associated cavities result in the possibility of the bead being more easily dislodged from the edge member.

Another problem encountered in the prior art results from the necessity of reducing the size of the bead to permit its insertion into the cavity of an edge member. A commom technique for permitting the reduction in size of the bead is to make it hollow, thereby permitting the bead to be compressed for reception into the retaining cavity of an edge member. Unfortunately, it has been found that such prior art hollow beads operate in reverse in that being subject to compression they can be easily pulled out of the edge member cavity under various conditions, such as water intrusion and freezing.

SUMMARY OF THE INVENTION

Accordingly, one object of the present invention is to provide a new and improved elastomeric expansion seal having mounting or retaining beads along the longitudinal edges thereof for insertion into the cavity of an edge member wherein each bead is affirmatively retained in engagement with the cavity wall so as to resist the intrusion of water and other debris.

Another object of the present invention is to provide a beaded seal as generally described hereinabove wherein the mounting beads thereon are of hollow construction and include a spring shaped wall portion for urging the bead into locked engagement with the associated edge member cavity so as to resist lateral dislodgement therefrom.

A further object of the present invention is to provide a beaded elastomeric seal wherein the bead may be easily inserted into the cavity of an edge member and be effectively retained therein in the presence of limited non-uniformities in the cavity configuration as resulting from the manufacture of the edge member.

A still further object is to provide relief portions in the outer surface of the seal beads in order to facilitate the mounting thereof in the edge members.

Still another object of the present invention is to provide a beaded expansion joint seal wherein lateral dislodgement of the beads from the associated edge member cavities is resisted during the various degrees of expansion and contraction of the structural members associated with the joint.

In summary, the present invention provides a sealing strip for an expansion joint wherein the strip has an intermediate web portion for spanning the expansion gap with tubular mounting beads attached along each of the longitudinal edges of the web portion. Each of the mounting beads is adapted to be compressed for insertion into a C-shaped cavity of preselected curvature formed in an edge member as referred to hereinabove. The C-shaped cavity opens towards the expansion gap and includes opposed projecting portions defining an opening therebetween. Each mounting bead of the seal in a disassembled condition includes a vertical dimension nominally equal to the vertical dimension of the edge member cavity. In addition, a substantial part of the mid-portion of the outer wall of the bead is curved, which in a disassembled condition, has a radius of curvature less than the corresponding cavity wall so that upon insertion of the bead into the cavity the upper and lower portions of the bead laterally abut the spaced portions of the edge member defining the cavity opening and the curved mid-portion of the outer surface of the bead is affirmatively forced to assume the curvature of the cavity wall. In addition, relief portions are provided in the bead outer wall adjacent to the curved mid-portion to facilitate proper engagement of the bead in the edge member cavity. The bead also includes an S-shaped wall portion adjacent to the cavity opening when mounted therein and which is connected at its upper portion to the edge of the laterally extending web of the seal. The S-shaped wall portion operates as a spring and reacts to movement of the web portion during expansion and contraction of the joint to induce within the bead a locking pressure with respect to the edge member cavity whereby the bead is effectively retained therein throughout the operating range of the joint.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

DETAILED DESCRIPTION OF A PREFERRED EMBODIMENT

Figure 1:
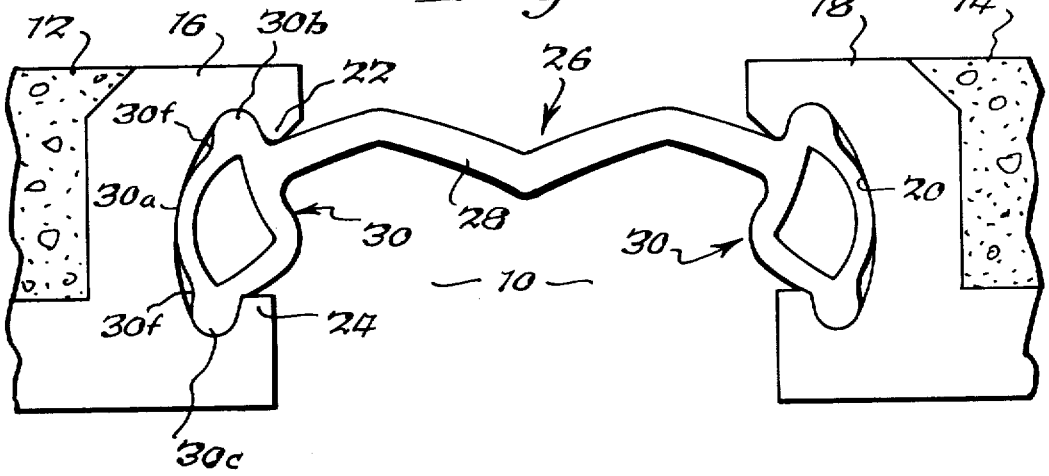
FIG. 1 is a vertical sectional view of an expansion joint according to the invention bridging a pair of spaced structural slab members.
Figure 4:
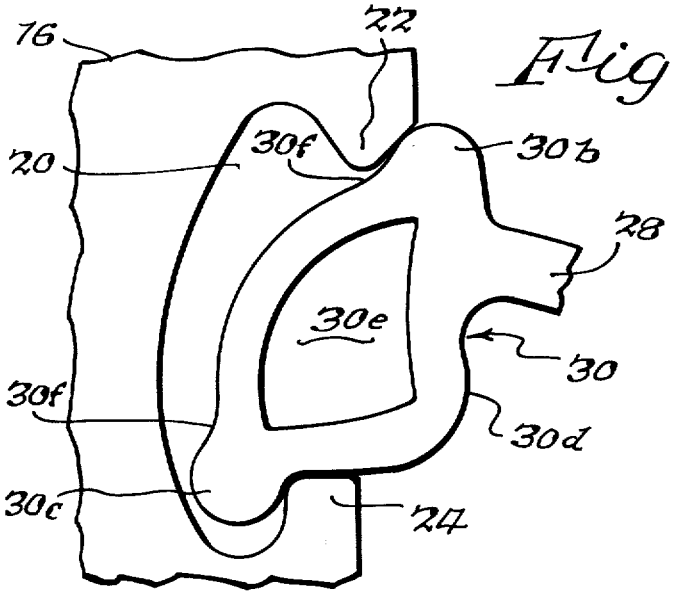
FIG. 4 is a vertical sectional view illustrating the bead portion thereof during its initial insertion into an edge member cavity.
Figure 5:
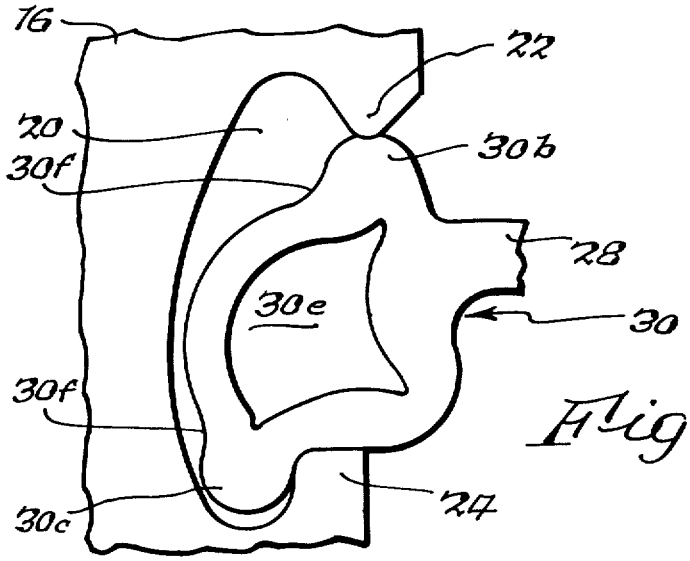
FIG. 5 is a view similar to FIG. 4 showing the mounting bead of the seal in an advanced position of insertion with respect to the edge member cavity.

Referring in detail to the illustrative embodiment depicted in the accompanying drawings, there is shown in FIG. 1 an expansion joint seal for bridging the gap 10 between a pair of structural slab members 12 and 14 as might be found in roadway and building construction. A pair of spaced apart, elongated edge members 16 and 18 are embedded or permanently affixed to the slabs 12 and 14 as is well known in the prior art. As shown most clearly in FIGS. 4 and 5, each of the edge members includes a C-shaped cavity 20 having a preselected radius of curvature wherein each of the cavities open toward the gap 10 as defined between the edge members 16 and 18. As further seen in FIGS. 4 and 5, each cavity opening is defined between opposed projecting portions of the edge member as indicated at 22 and 24 and which are spaced from each other a distance less than the maximum dimension within the cavity taken generally parallel to the opening defined between projections 22 and 24. In other words, the cavity opening is less than the vertical height of the cavity as seen in FIGS. 4 and 5.

Returning now to FIG. 1, an elongated resilient sealing strip 26 is shown in transverse cross section for assembly with the edge member cavities described hereinabove for sealing the gap 10. The sealing strip 26 includes a web portion 28 spanning the gap 10 and a mounting bead portion 30 extending along each longitudinal edge of web portion 28. As clearly seen in FIGS. 1-3, the web portion includes a longitudinal, downwardly extending fold located substantially along the center line of the gap 10 and accordingly folds downwardly in a manner corresponding to the degree of contraction in the width of gap 10. Each of the mounting beads 30 includes in cross section an outer curved surface portion **30*a* for matching engagement with the encompassing wall surface of cavity 20 when in assembled position therewith. The upper and lower opposed portions 30*b* and 30*c* of the bead are provided to correspondingly abut the opposed projecting portions 22 and 24 of the edge member whereby lateral movement of the bead towards the gap 10 is resisted as is apparent from FIGS. 1-3 and FIG. 6. In addition, relief portions or depressions shown as 30*f* are provided in the the outer wall surface of the bead adjacent to the edges of the curved mid-portion 30*a*. Relief portions 30*f* extend between mid-portion 30*f* and the portions 30*b* and 30*c* of the bead. As will be more fully described hereinbelow, the curved mid-portion 30*a* of the outer wall in an unstressed, disassembled form is provided with a preselected radius of curvature which is less than the radius of curvature of the corresponding wall portion in cavity 20. As is apparent from FIG. 7, the configuration of bead 30 in an unstressed, disassembled position would appear as that shown in solid line while after assembly within cavity 20**, the bead would assume the contour shown in dotted line.

As is to be further understood from FIGS. 4-7, each mounting bead 30 being of a tubular configuration includes a spring shaped wall portion **30*d* which extends between the bead portions 30*b* and 30*c* so as to provide the aforesaid tubular configuration to the bead. As will be also more fully described hereinbelow with respect to the operational characteristics of the present seal, the wall portion 30*d* of the bead is generally of S-shaped configuration which S-shaped configuration is subject to changes in form depending upon the degree of expansion or contraction of gap 10**.

In describing the operation of the seal and in particular the mounting beads thereon, consideration will first be given to the static characteristics of each bead 30 in an assembled position and then consideration will be given to the dynamic characteristics of each bead 30 during expansion and contraction of the structural slab members.

As described hereinabove, the radius of curvature of mid-portion **30*a* of the bead wall prior to assembly is less than the radius of curvature of the corresponding cavity wall portion. As shown in FIGS. 4 and 5, it is apparent that the bead may be compressed so as to be inserted through the opening defined by the edge member projections 22 and 24. In this manner, bead portion 30*c* becomes locked behind edge member projection 22 to assume the assembled position shown in FIG. 6 and FIGS. 1-3. However, the locking of the upper and lower portions of the bead against projections 22 and 24 will affirmatively force the mid-portion 30*a* of the bead wall to assume the curvature of the adjacent cavity wall as clearly indicated in dotted line manner in FIG. 7. The term "radius of curvature" with respect to an edge member cavity is relative to the bead mid-wall portion 30*a*. Potentially the mid-portion of the edge member cavity wall could be flat — or in other words have an "infinite radius of curvature" which would be greater than the radius of curvature of bead portion 30*a* in a normal condition. As is apparent from FIG. 7, the cavity wall will be in firm engagement with the mid-portion 30*a* of the bead wall as indicated by vector 34. Such a modification of the curvature of the wall mid portion 30*a* will tend to induce bead portions 30*b* and 30*c* to separate from one another. However, when the nominal vertical height of the bead in a disassembled position is generally equal to the vertical height of cavity 20, the bead 30 becomes only more firmly locked within cavity 20 as the upper and lower portions of the bead are forced into a tighter engagement with the adjacent portions of the cavity as the curvature of the wall mid-portion 30a** is modified by its engagement with the adjacent cavity wall.

Figure 6:
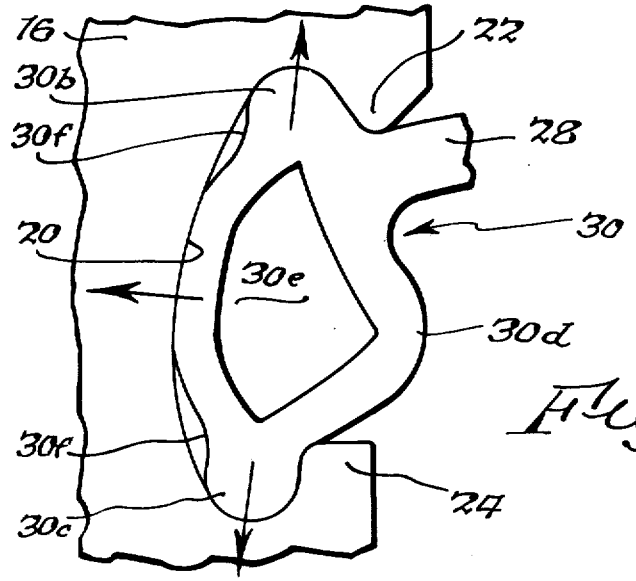
FIG. 6 is a view similar to FIGS. 4 and 5 showing the mounting bead fully inserted within the edge member cavity.
Figure 7:
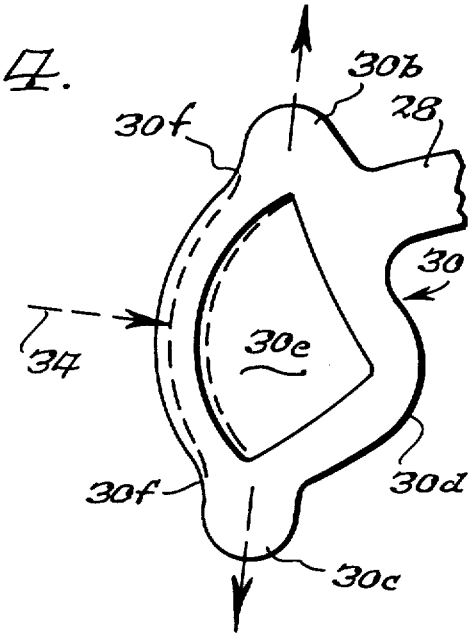
FIG. 7 illustrates in dotted line form the cross-sectional configuration of the mounting bead in a mounted condition as opposed to the solid line cross sectional configuration of the bead in an unstressed, disassembled condition.

As shown by the force vectors in FIG. 6, the curved wall mid-portion 30a of the bead will necessarily develop a reaction force to firmly engage the cavity wall. It therefore can be understood that the insertion of the bead 30 within cavity 20 develops an internal locking pressure within the bead by the modification of the curvature of mid-portion 30a and that any variations in the cross sectional configuration of cavity 20 will be compensated for by such internal locking pressure developed within the bead whereby the latter tends to positively engage the surrounding cavity wall.

Figure 2:
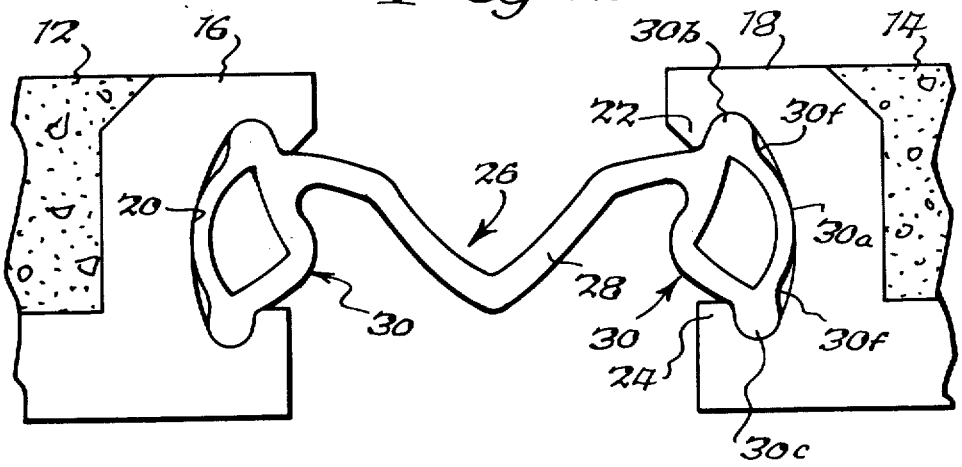
FIG. 2 is a vertical sectional view similar to FIG. 1 showing the seal of the present invention in a partially compressed condition.
Figure 3:
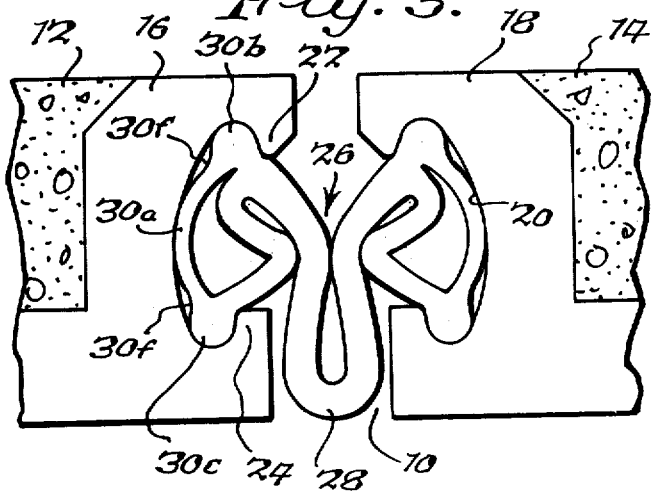
FIG. 3 is a view similar to FIGS. 1 and 2 showing the seal of the present invention in a fully compressed condition.

As referred to hereinabove, the spring wall portion 30d of the bead operates in a dynamic sense to further insure the effective retention of bead 30 within cavity 20 at all times. As the seal 26 approaches its maximum bridging capacity as shown in FIG. 1, during extreme contraction of the slab members 12 and 14, the spring leg or wall portion 30d tends to straighten out and thereby produce pressure on bead portions 30b and 30c which in turn tends to create a locking effect to prevent the seal from slipping out of the cavity 20. As the slab members 12 and 14 expand in various degrees, thereby closing or narrowing the gap 10 as shown in FIGS. 2 and 3, the spring portion 30d of the bead tends to fold into the hollow, internal cavity 30e of the bead. Under extreme expansion of the slab members, the spring portion 30d will press against the bead wall portion 30a as shown in FIG. 3, creating pressure and a spring reaction force towards bead portions 30b and 30c which similarly operates to maintain water tightness and a firm lock on the seal.

From the foregoing, it is apparent that the objects of the present invention have been fully accomplished. As a result of this invention, an improved elastomeric seal has been provided to have mounting beads which are firmly locked in associated cavities of edge members in the joint structure. Static locking of the bead is primarily made more effective by the affirmative change in curvature of the mid-portion of the bead wall by its engagement with the cavity wall while dynamic locking of the bead is made more effective by the attachment of the spring leg or wall portion 30d with the web portion 28 of the seal.

Having thus described and illustrated a preferred embodiment of the invention, it will be understood that such description and illustration is by way of example only and such modifications and changes as may suggest themselves to those skilled in the art are intended to fall within the scope of the present invention as limited only by the appended claims.

I claim:

1. An expansion joint seal for bridging the gap between a pair of structural slab members, said expansion joint seal comprising:

a pair of spaced-apart, elongated edge members being respectively disposed in said structural slabs to define a gap there between, each said edge member having in cross-section a generally C-shaped cavity with a preselected radius of curvature, each said cavity opening toward said gap defined between said edge members wherein each said cavity opening is defined between opposed projecting portions of said respective edge members spaced from each other a distance less than the maximum dimension within said cavity taken generally parallel to said opening, an elongated resilient strip sealing said gap between said edge members, said strip including a web portion spanning said gap and a mounting bead portion extending along each longitudinal edge of said web portion wherein each of said mounting bead portions is received within said cavity of a respective edge member, and each mounting bead having in cross-section an outer surface portion for matching engagement with said cavity with opposed portions of said mounting bead correspondingly abutting said opposed projecting portions of said edge member whereby relative lateral movement of said mounting bead with respect to said edge member is resisted, said mounting beads further having relief portions disposed in the outer surface thereof intermediate to the mid-portion and said opposed portions thereof, and the radius of curvature of said outer surface of said mounting bead in an unstressed, disassembled form being less than said preselected radius of curvature of said cavity so that upon assembly of said mounting bead within said edge member cavity said outer surface of said mounting bead is affirmatively urged to assume the greater radius of curvature of said cavity by the abutment of said opposed portions of said mounting bead with opposed projecting portions of said edge member.

2. The expansion joint seal as set forth in claim 1 wherein the nominal dimension of said mounting bead, in a disassembled condition, which corresponds to said maximum dimension within said cavity taken generally parallel to said opening is generally equal thereto so that upon assembly of said mounting bead within said cavity said mounting bead develops a locking pressure therein.

3. The expansion joint seal as set forth in claim 1 wherein each of said mounting beads is in cross-section of hollow, tubular configuration and includes a spring shaped wall portion extending between said opposed portions of said mounting bead which abut said opposed projecting portions of said edge member.

4. The expansion joint seal as set forth in claim 3 wherein said web portion of said strip is attached to said spring shaped wall portions of said mounting beads in a manner so that movement of said web portion resulting from expansion and contraction of said structural slab members induces said opposed portions of each said mounting bead connected to said spring shaped wall portion to separate one from the other.

5. The expansion joint seal as set forth in claim 4 wherein each spring shaped wall portion is of generally S-shaped configuration.

6. The expansion joint seal as set forth in claim 5 wherein said web portion is attached to the upper edge portion of said spring shaped wall portions.

7. The expansion joint seal as set forth in claim 6 wherein said web portion includes a longitudinal, downwardly extending fold located substantially along the center line of said gap defined between said structural slab members.

8. The expansion joint seal as set forth in claim 2 wherein each of said mounting beads is in cross-section of hollow, tubular configuration and includes a spring shaped wall portion extending between said opposed portions of said mounting bead which abut said opposed projecting portions of said edge member.

9. The expansion joint seal as set forth in claim 8 wherein said web portion of said strip is attached to said spring shaped wall portions of said mounting beads in a manner so that movement of said web portion resulting from expansion and contraction of said structural slab members induces said opposed portions of each said mounting bead connected to said spring shaped wall portion to separate one from the other.

10. The expansion joint seal as set forth in claim 9 wherein each spring shaped wall portion is of generally S-shaped configuration.

11. The expansion joint seal as set forth in claim 10 wherein said web portion is attached to the upper edge portion of said spring shaped wall portions.

12. The expansion joint seal as set forth in claim 11 wherein said web portion includes a longitudinal, downwardly extending fold located substantially along the center line of said gap defined between said structural slab members.

13. The expansion joint seal as set forth in claim 8 wherein the mid-portion of said edge member cavity when viewed in cross-section is substantially flat.

14. The expansion joint seal as set forth in claim 8 wherein only the mid-portion of said mounting bead outer surface when viewed in cross-section engages said cavity.

15. The expansion joint seal as set forth in claim 1 wherein the mid-portion of said edge member cavity when viewed in cross-section is substantially flat.

16. The expansion joint seal as set forth in claim 1 wherein only the mid-portion of said mounting bead outer surface when viewed in cross-section engages said cavity.

* * * * *